US006568491B1

(12) United States Patent
Matthews, III et al.

(10) Patent No.: US 6,568,491 B1
(45) Date of Patent: May 27, 2003

(54) METHOD FOR APPLYING HARDFACING MATERIAL TO A STEEL BODIED BIT AND BIT FORMED BY SUCH METHOD

(75) Inventors: Oliver Matthews, III, Spring, TX (US); David P. Miess, Highland, UT (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/873,912

(22) Filed: Jun. 4, 2001

Related U.S. Application Data

(60) Provisional application No. 60/111,109, filed on Dec. 4, 1998.

(51) Int. Cl.[7] ..... E21B 10/08
(52) U.S. Cl. ..... 175/374; 76/108.2; 76/108.4
(58) Field of Search ..... 76/108.2, 108.4; 175/374, 425, 426, 435

(56) References Cited

U.S. PATENT DOCUMENTS 4,499,795 A * 2/1985 Radtke ..... 76/108.2
4,597,456 A * 7/1986 Ecer ..... 175/371
5,425,288 A 6/1995 Evans ..... 76/108.2
5,737,980 A 4/1998 Keith et al. ..... 76/108.2
6,238,454 B1 * 5/2001 Polese et al. ..... 75/243

* cited by examiner

*Primary Examiner*—William Neuder
(74) *Attorney, Agent, or Firm*—Carlos A. Torres; Browning Bushman, P.C.

(57) ABSTRACT

A graphite or silicate plug is coated with a refractory metal and positioned in the cutter pocket of a steel bodied bit as molten hardfacing material is applied to the bit surface under high temperature conditions. The refractory metal cooperates with the hardfacing material to act as a wetting agent that draws the hardfacing material into intimate contact with the body of the displacement plug. The plug is removed leaving a composite pocket opening formed by the steel body and the hardfacing material. A PDC cutter inserted into the composite pocket opening closely adheres to the sides of the opening to reduce the gap between the cutter and the hardfacing material to hereby minimize the effects of erosion in the area of the gap. The wetting material on the displacement plug permits the hardfacing material to flow into and remain in position immediately adjacent the displacement body and in the small surface area between adjacent cutter pockets. The hardfacing material also cooperates with the-steel pocket to increase the surface area of the pocket recess that provides additional structural support to the cutter to improve the stability and retention of the cutter in the bit. The refractory metal may preferably be molybdenum that is applied in a thin layer deposited by a plasma coating technique directly over the body of the graphite displacement body.

10 Claims, 3 Drawing Sheets

METHOD FOR APPLYING HARDFACING MATERIAL TO A STEEL BODIED BIT AND BIT FORMED BY SUCH METHOD

CROSS REFERENCE TO RELATED APPLICATIONS

This application is related to and claims the benefit of the filing date of U.S. Provisional Application Ser. No. 60/111,109 filed Dec. 4, 1998 and International Application No. PCT/US99/28645 filed Dec. 3, 1999.

FIELD OF THE INVENTION

The present invention relates generally to drill bits used to bore through earthen formations. More specifically, the present invention relates to steel bodied drill bits and the methods employed in securing polycrystalline diamond compact (PDC) cutters to such bits.

BACKGROUND OF THE INVENTION

Steel bodied bits customarily employ PDC cutters that are secured to the bit by mounting the cutter in a receptacle or pocket formed in the bit body and brazing the cutter into the steel pocket. Hardfacing material such as tungsten carbide is also applied to the steel body of the bit to strengthen the bit and reduce bit body wear. The hardfacing material is applied in a layer by heating the material to its liquid or molten state with an oxyacetylene torch or other suitable means to bond the hardfacing material to the steel of the bit body. The high temperatures required to apply the hardfacing material to the steel bodied bit are damaging to the diamond portion of the PDC cutter so that the cutter must be secured to the bit after the hardfacing step has been completed.

It is undesirable to form the pocket for the cutter after the hardfacing material has been applied because of the difficulty in machining or cutting through the extremely hard hardfacing material. Conventionally, a cutter pocket is formed in the steel bit body before the hardfacing is applied, and a graphite or silicate displacement plug is temporarily used to occupy the pocket during the application of the hardfacing material. After the application of the hardfacing material, the displacement plug is ground out or otherwise removed from the pocket. One of the problems with the described technique is that the molten hardfacing material does not bond to the graphite or silicate displacement plug and can in fact shrink away from the material of the plug so that a gap is left between the plug body and the surrounding hardfacing material. Additionally, where several cutters are closely spaced, the area between the adjacent cutters may not be sufficiently large to permit deposition of the molten hardfacing material due, in part, to the shrinkage characteristic of the hardfacing material. The high temperatures can also melt the relatively thin web of steel between closely spaced sockets. In either case, when the cutter is inserted into the pocket, a gap exists between the body of the cutter and the surrounding hardfacing. This gap may be filled with a brazing material, however, the erosion resistance of the brazing material is not as good as that of the hardfacing material. During use of the bit in drilling the high pressure drilling fluids and entraining abrasives in the fluid erode the brazing material or steel in the gap between the cutter body and the hardfacing material, eventually leading to loosening and even loss of the cutter.

SUMMARY OF THE INVENTION

The displacement plug is coated with a thin layer of material such as a refractory metal that acts as a wetting agent allowing the molten hardfacing material to adhere to the displacement plug. When the plug is removed, the cured hardfacing material remains disposed immediately adjacent the cutter pocket and has opening dimensions over the cutter pocket that substantially conform to the dimensions of the cutter. The hardfacing material and steel defining the cutter pocket within the bit body cooperate to form a deeper composite pocket that has a significantly reduced gap between the hardfacing material and the cutter body. The small areas between adjacent cutters are also filled with the hardfacing material and provide a similar composite pocket that closely surrounds the cutter.

The method of the present invention reduces the area exposed to erosion around the cutter and further provides the additional structural support of hardfacing material against the cutter body to enhance the structural strength of the connection between the cutter and the steel bit.

From the foregoing it will be appreciated that a primary object of the present invention is to provide a method for extending the hardfacing material employed on a steel bodied bit to the edges of the pocket holding a PDC cutter to minimize the gap between the hardfacing material and the cutter and to strengthen the structural engagement between the cutter and the bit body.

Another object of the present invention is to provide a bit in which the gap between the cutter body and the surrounding hardfacing material of the bit is reduced to a minimum to prevent the erosion of softer material in the gap between the hardfacing material and the cutter body.

Yet another object of the present invention is to provide an inexpensive method for forming a bit having a hardfacing layer that includes a cutter receiving opening having close dimensional tolerance with a cutter to be received in the opening without the need for machining or milling through the hardfacing material.

Another object of the present invention is to provide a means for maintaining a close tolerance opening for receiving a cutter in a steel bit pocket wherein high temperatures are employed in the application of hardfacing material to the surface of the steel bodied bit.

A specific object of the present invention is to provide a method in which a refractory metal is employed to coat a disposable displacement plug wherein the refractory metal will act as a wetting agent to combine with hardfacing material applied at high temperatures to secure the hardfacing material to the displacement member. The cured hardfacing is left at a location that closely approximates the external dimensions of the displacement member exposed from the steel pocket to thereby provide a composite receptacle or pocket for receiving a cutter on a steel bodied bit with a minimum of space between the body of the cutter and the opening through the hardfacing material.

The foregoing objects, features and advantages of the invention as well as others will be more readily understood and appreciated by reference to the following drawings, specifications and claims.

DETAILED DESCRIPTION OF PREFERRED EMBODIMENTS

Figure 1:
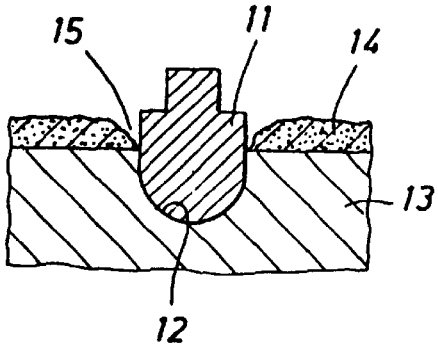
FIG. 1 (PRIOR ART)
FIG. 1 illustrates a prior art technique for employing a displacement in the cutter pocket during the application of hardfacing material to the steel bit body.

FIG. 1 illustrates a graphite or silicate displacement 11 positioned in a cutter pocket 12, formed in the body 13 of a steel bodied bit (only partially illustrated). The hardfacing material 14 is applied to the outer surface of the bit 13. The hardfacing material 14 is comprised of a mixture of tungsten carbide materials or other suitable materials that can provide a protective or abrasive coating superior to that of the material of the steel bodied bit 13. The hardfacing material 14 is customarily applied by heating the material to a molten state and applying it to the surface of the bit. In the molten state, the hardfacing material combines with the steel of the bit 13 securing the hardfacing coating in place.

Figure 2:
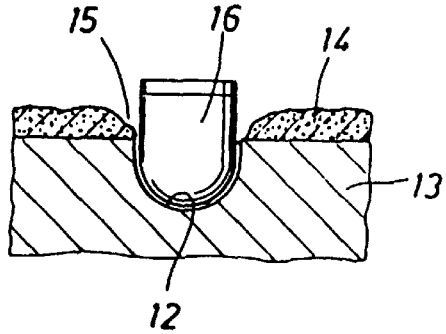
FIG. 2 (PRIOR ART)
FIG. 2 illustrates a cutter employed in a bit having hardfacing applied in the prior art manner illustrated in FIG. 1.

A natural characteristic of the molten hardfacing material 14 is such that it will not combine with or adhere to the material of the displacement member 11. As a result, a gap 15 forms between the cured hardfacing material 14 and the external surface of the displacement plug 11. After the hardfacing material has been applied and cured, the displacement plug 11 is removed and a cutter 16 is inserted into the pocket as illustrated in FIG. 2. The cutter 16 is secured within the bit pocket 12 by the application of a brazing material (not illustrated) or by other conventional techniques. the gap 15 and any brazing material within the gap, between the hardfacing layer 14 and the body of the cutter 16 is exposed to erosion caused by the effects of the high pressure drilling fluids used in drilling with the bit 13. Eventually, the loss of the material surrounding the cutter 16 allows the cutter to loosen or fall free of the pocket 12.

Figure 3:
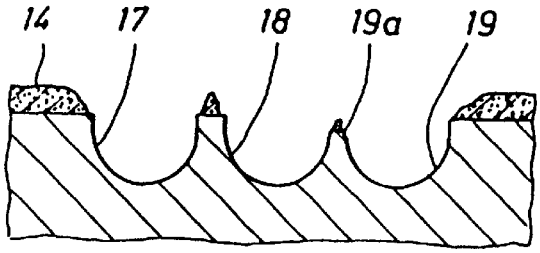
FIG. 3 (PRIOR ART)
FIG. 3 illustrates gaps in the hardfacing appearing between the pockets of closely disposed cutter pockets on a prior art steel bodies bit.

FIG. 3 illustrates the bit 13 with several closely spaced pockets 17, 18 and 19 surrounded by the hardfacing layer 14. Because of the failure of the hardfacing 14 to suitably bind to the displacements used during the application of the hardfacing, the small surface areas of the steel bit between the pockets 17 and 18, and 18 and 19, are devoid of hardfacing material. The heat of application can also melt the metal web between pockets as indicated at 19*a* so that the little amount of hardfacing actually applied is supported by a reduced surface of the steel bit body. The resulting gaps between the cutters positioned in the pockets 17, 18 and 19 are subject to erosion in the manner described with reference to the cutter of FIG. 2.

Figure 4:
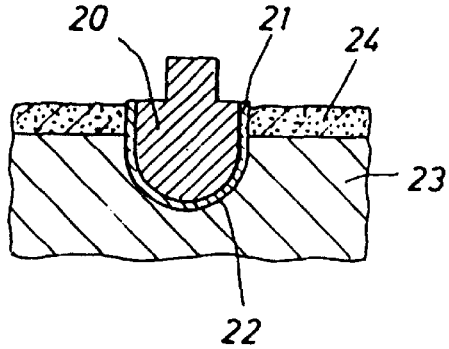
FIG. 4 illustrates a displacement according to the present invention employed to protect the cutter pocket during the application of hardfacing material.

FIG. 4 illustrates a displacement plug 20 having a coating 21 of a suitable high temperature wetting material, such as a refractory metal, disposed in a pocket 22 formed in a steel bit 23. A layer of hardfacing material 24 is applied to the surface of the bit 23 and extends into physical contact with the coating 21.

The coating 21, which may be a refractory metal such as molybdenum is disposed on the displacement plug 20, which may be a material such as graphite, silica, or other suitable material that remains stable at high temperatures. The coating is applied in a conventional plasma coating procedure or other suitable procedure. The coating 21 is relatively thin and covers the entire external surface of the displacement plug 20 within the area in engagement with the pocket 22 and the hardfacing layer 24. The coating 21 may be substituted with a suitable separate layer of wetting material. The thickness of the plasma applied wetting material may be 0.003" or less.

In practicing the present invention, a displacement plug 20 coated with the thin molybdenum layer 21 is held in a closely conforming pocket 22 as the hardfacing material 24 is applied to the steel bodied bit 23. The temperature rendering the hardfacing material 24 molten is sufficient to cause the molybdenum coating 21 to melt and act as a wetting surface that combines with the hardfacing material to bond the hardfacing material to the displacement plug 20. These temperatures are well in excess of the temperatures at which a PDC cutter would be severely damaged. The application of the hardfacing material may be performed in a controlled atmosphere to prevent oxidation or other adverse reaction in the wetting materials. The use of a controlled atmosphere permits the thickness of the coating 21 to be reduced.

Figure 5:
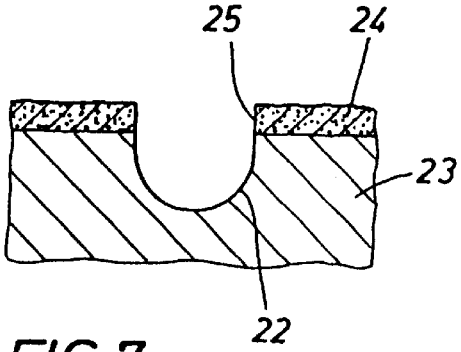
FIG. 5 illustrates a cutter pocket formed using the method of the present invention.
Figure 6:
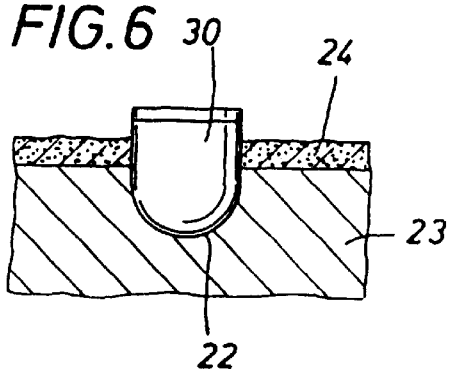
FIG. 6 illustrates a cutter disposed in a pocket to which hardfacing has been applied to a bit in accordance with the teaching of the present invention.

After the hardfacing is applied, the displacement 20 and any portions of the remaining coating 21, as desired, are removed to produce a pocket as illustrated in FIG. 5. The opening 25 to the hardfacing layer 24 is substantially the same dimension as the opening to the pocket 22. As may be seen with reference to FIG. 6, a cutter 30 mounted in the pocket 22 is closely surrounded by the steel of the bit and the hardfacing layer 24. The substantial reduction in the spacing between the hardfacing layer 24 and the body of the cutter 30 minimizes the area of exposure to erosion and increases the structural support of the cutter within the pocket 22.

Figure 7:
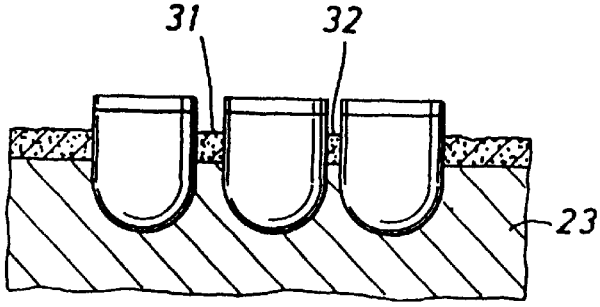
FIG. 7 illustrates multiple cutters disposed in cutter pockets formed during the hardfacing application of the present invention.

FIG. 7 illustrates several closely spaced cutters disposed in pockets prepared employing displacement plugs of the present invention. As may be observed, the small areas 31 and 32 between adjacent cutters retain the hardfacing material serving to protect the underlying steel surface and further increase the structural support for the surrounded cutters. Even when melting of the intermediate steel web occurs, the layer of hardfacing material protects the cutter pocket because of the absence of the gap between the hardfacing and the cutter.

Figure 8:
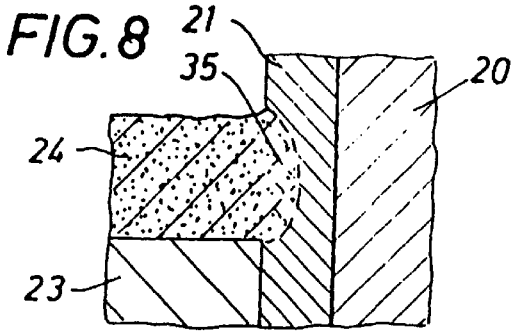
FIG. 8 illustrates details in the bonding between bit hardfacing material and the wetting material displacement coatings of the present invention.

FIG. 8 illustrates an enlarged view of the interface between the hardfacing layer 24 and the molybdenum coating 21. During the heating application of the hardfacing material, an area 35 chemically combines with the molybdenum 21 and hardfacing materials 24 to form a bonded structure. Depending on the thickness of the layer 21, the layer may be left in place with only the graphite (or silicate) of the displacement plug being removed to accommodate a cutter having external dimensions conforming with the internal dimensions of the coating 21.

Figure 9:
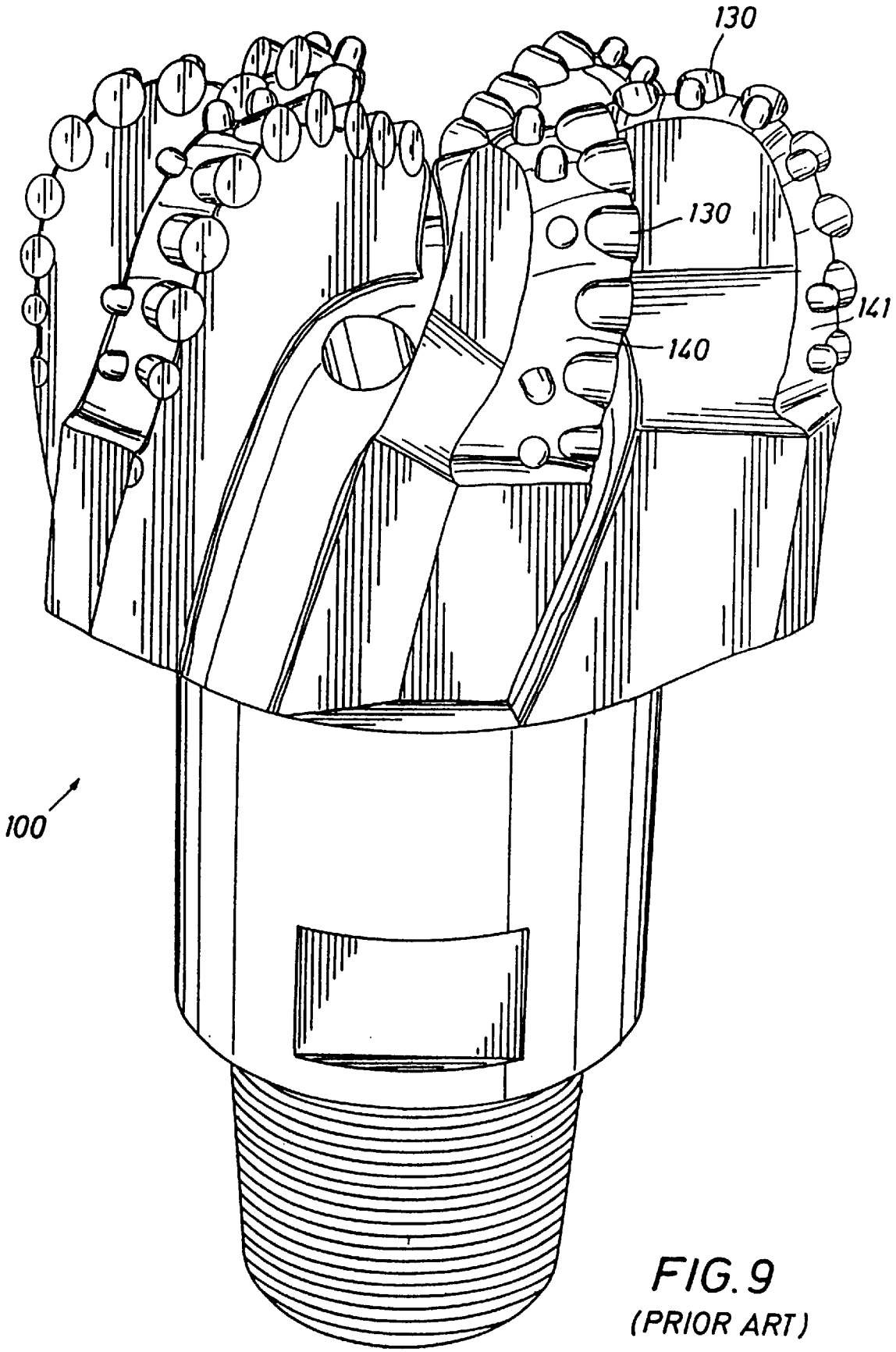
FIG. 9 (PRIOR ART)
FIG. 9 illustrates a bit without hardfacing.

FIG. 9 illustrates a steel bodied bit 100 having cutters 130 disposed at the ends of the bit blades 140 and 141.

Figure 10:
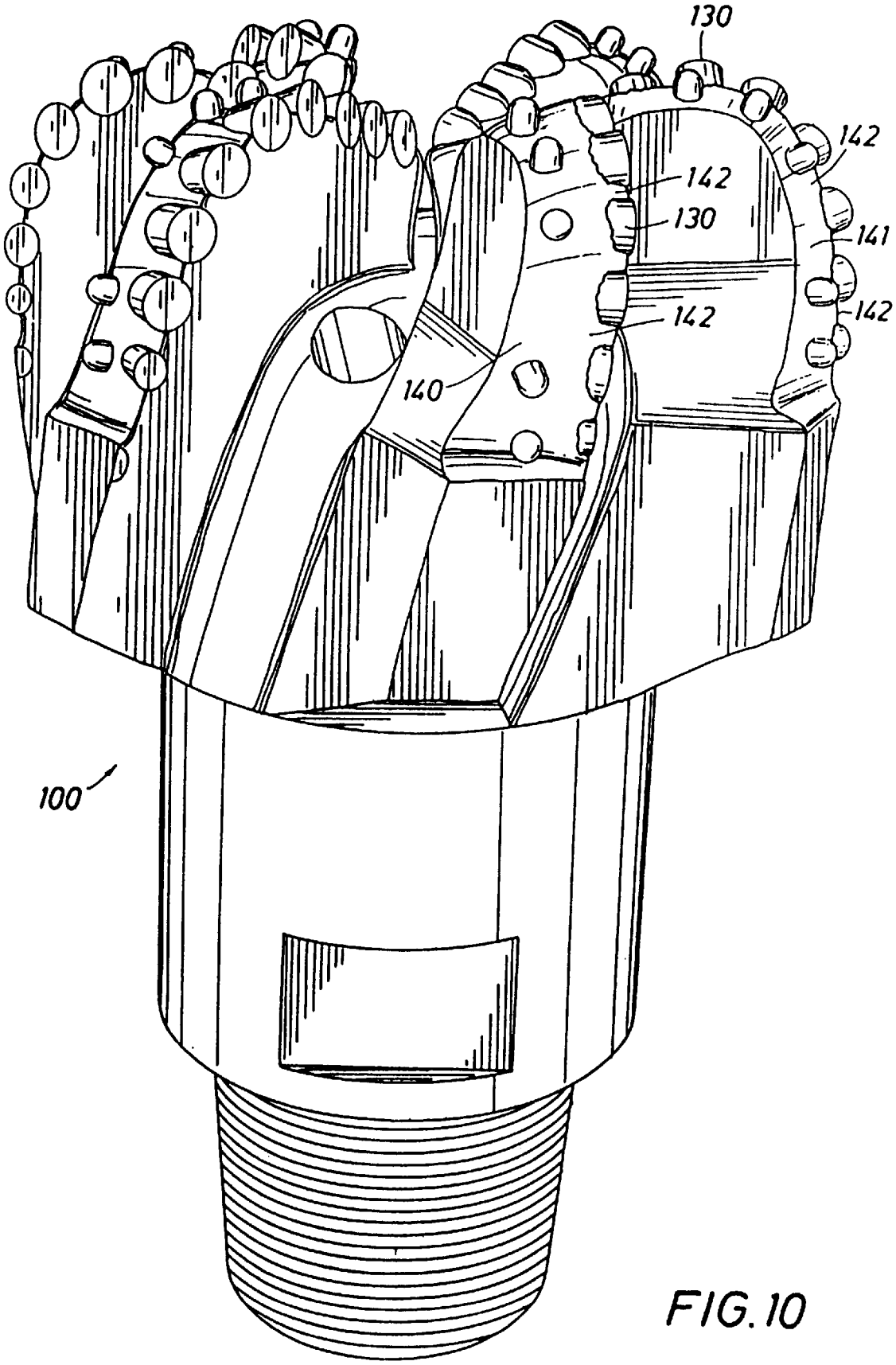
FIG. 10 illustrates a bit having hardfacing applied to the cutters of two of the bit blades of FIG. 9 in accordance with the teachings of the present invention.

FIG. 10 illustrates the cutters 130 on the blades 140 and 141 having hardfacing material 142 applied in accordance with the teachings of the present invention. As may be noted by comparing FIGS. 9 and 10, the hardfacing material forms a covering around the cutters that cooperates with the steel pocket of the bit body to form a larger composite pocket that improves the retention of the cutters 130 and also protects the underlying steel of the bit body from erosion.

Suitable refractory metals that may be employed are molybdenum, tungsten, tantalum, rhenium and niobium. Molybdenum is preferred because of its suitability for fusion application and its relatively low cost. Other high melting point materials that permit the required bonding between the hardfacing material and the displacement body may also be used.

In one example of the use of the method of the present invention, a 19 mm PDC cutter having a diameter of 0.750"–0.752" was employed in a cutter pocket having a diameter of 0.757"–0.761". A graphite displacement plug having a diameter of 0.750"–0.751" was coated with a layer of molybdenum to a diameter of 0.755"–0.757" using a plasma coating technique.

What is claimed is:

1. A method for securing a cutter to a steel bodied bit comprising:

forming a cutter pocket in said bit, said cutter pocket having an opening extending through a surface of said bit;

placing a displacement plug into said pocket;

disposing a layer of wetting material intermediate said displacement plug and said pocket, said wetting material engaging said opening of said pocket;

applying a hardfacing material to said bit surface and said wetting material in the area adjacent said opening;

removing said displacement plug to form a cutter receiving area within said pocket; and inserting a cutter into said cutter receiving area.

2. A method as defined in claim 1 wherein said wetting material comprises a refractory metal.

3. A method as defined in claim 1 wherein said displacement plug comprises a high temperature stable material.

4. A method as defined in claim 2 wherein said refractory metal is molybdenum.

5. A method as defined in claim 3 wherein said stable material is graphite or a silicate.

6. A method for securing a cutter to a steel bodled bit comprising:

forming a cutter pocket in said bit, said cutter pocket having an opening extending through a surface of said bit;

placing a displacement plug into said pocket;

disposing a layer of wetting material different from the material of the displacement plug intermediate said displacement plug and said pocket, said wetting material engaging said opening of said pocket;

applying a layer of molten hardfacing material to said bit surface and into engagement with said wetting material in the area adjacent said opening by heating said hardfacing material whereby a layer of said hardfacing material engages said displacement plug to a major portion of the depth of the hardfacing material layer;

cooling said hardfacing material while retaining engagement of a major portion of the depth of the hardfacing material layer with said displacement plug;

removing said displacement plug to form a cutter receiving area within said pocket wherein said cutter receiving area comprises a finished pocket having a substantially uniform inside diameter comprised of said hardfacing material layer and the internal surface of said finished pocket; and inserting a cutter into said finished pocket.

7. A method as defined in claim 6 when said wetting material comprises a refractory metal.

8. A method as defined in claim 7 wherein said refractory metal is molybdenum.

9. A method as defined in claim 6 wherein said displacement plug comprises a high temperatures stable material.

10. A method as defined in claim 9 wherein said stable material is graphite or a silicate.

* * * * *